US006565226B1

(12) United States Patent
Cummings

(10) Patent No.: US 6,565,226 B1
(45) Date of Patent: May 20, 2003

(54) MAGAZINE-MOUNTED, INTEGRAL FIREARM LIGHTING SYSTEM

(76) Inventor: Thomas Allen Cummings, 3855 Clarkway Rd., Jackson, MI (US) 49203

( * ) Notice: Subject to any disclaimer, the term of this patent is extended or adjusted under 35 U.S.C. 154(b) by 0 days.

(21) Appl. No.: 10/054,121

(22) Filed: Nov. 13, 2001

(51) Int. Cl.[7] ..... F41G 1/34

(52) U.S. Cl. ..... 362/110; 362/113; 362/114; 42/146

(58) Field of Search ..... 362/109, 102, 362/110, 113, 114; 42/132, 164, 146

(56) References Cited

U.S. PATENT DOCUMENTS

| | | | | |
|---|---|---|---|---|
| 1,201,052 | A | 10/1916 | Jakubyansky | |
| 3,222,511 | A | 12/1965 | Breeding | 240/6.41 |
| 3,513,851 | A | 5/1970 | Smith et al. | 128/422 |
| 4,758,933 | A | 7/1988 | Winberg et al. | 362/110 |
| 5,353,208 | A | 10/1994 | Moore | 362/202 |
| 5,727,346 | A | 3/1998 | Lazzarini et al. | 42/103 |
| 5,758,488 | A * | 6/1998 | Thummel | 42/114 |

* cited by examiner

*Primary Examiner*—Sandra O'Shea
*Assistant Examiner*—Sharon Payne
(74) *Attorney, Agent, or Firm*—Gifford, Krass, Groh, Sprinkle, Anderson & Citkowski, PC

(57) ABSTRACT

Use of this invention enables a commercially available flashlight to be mounted on or in the forward end of a firearm's magazine, thereby configuring a source of illumination in precise alignment with the bore of the gun. In contrast to prior-art devices, the inventive approach requires no modification to the gun in general or magazine in particular, and may consume the space taken by a single shell, allowing the remainder of the magazine to hold shells, as is typical. The preferred embodiment permits certain types of barreled flashlights, such as the Maglight®, Smith & Wesson® or Dorcy® having a diameter on the order of 7/10 inch to be mounted on or into the forward end of the magazine through the use of an adapter base module. To position the non-illuminating end of the flashlight in alignment relative to the spring present in the magazine, an optional spring guide in used.

4 Claims, 2 Drawing Sheets

MAGAZINE-MOUNTED, INTEGRAL FIREARM LIGHTING SYSTEM

FIELD OF THE INVENTION

This invention relates generally to gun-mounted illumination devices and, in particular, to apparatus enabling certain types of commercially available flashlights to be mounted on or within the forward end of a firearm's magazine.

BACKGROUND OF THE INVENTION

Various patents have issued in conjunction with mountable illumination devices for handguns, rifles and other weapons. U.S. Pat. No. 1,201,052, for example, relates to improvements in the construction of firearms, and more particularly, to guns, revolvers and the like which are adapted to incorporate a mechanism for operating an electric flashlight. Integrally formed below the gun barrel, and parallel thereto, is a cylindrical member into which a battery is inserted. A lamp is carried in the cap, which is frictionally engaged on the forward end of the member to position the lamp relative to the battery. A pushbutton is positioned so as to be conveniently operated by the finger of one holding the gun. Pressure on the pushbutton operates a triangular lever which, in turn, causes contact with an end of the battery causing it to illuminate.

U.S. Pat. No. 3,222,511 resides in a gun barrel mounted flashlight mount and switch. The flashlight or alternative illumination means includes a body portion which may be readily removably secure to a gun barrel or gun stock in a manner so as to position the illumination means to cast a beam of light along the line of sight of the gun barrel. The illumination means may be of a special construction or may be in the form of a somewhat modified conventional flashlight. An automatic switch responsive to positioning the body of the flashlight is serially connected in a bypass circuit, and thus may be utilized to activate the illumination means independently of the conventionally manually actual switch means. A pair of spring clip assemblies are provided and utilized to removably secure the flashlight to hand grip portion of the stock. Each spring clip includes a resilient U-shape portion which is adapted to be clampingly engaged with the hand grip portion and a C-shape resilient portion which is adapted to be clampingly engaged with the body of the flashlight.

U.S. Pat. No. 3,513,851 is directed to a flashlight attachment for guns. The attachment is in the form of a small cylindrical insulated housing to be positioned in the forward open end of the cartridge magazine of a shot gun and to be removably held in fixed position therein and protected thereby. The housing contains the usual flashlight components, and the forward end thereof, projecting from the magazine, is provided with a rotatable cap functioning to hold the flashlight components within the housing and further serving as a means for turning the flashlight on and off.

U.S. Pat. No. 4,758,933 is directed to police officers faced with the problem that when a flashlight is held in one hand and the gun in the other, the officer is at a disadvantage since he usually cannot aim accurately using only one hand. It is also difficult to point both a flashlight and a gun accurately towards the same target. It is therefore an object of the invention to allow the use of a firearm and flashlight or other object simultaneously while maintaining a conventional two-handed grip on the weapon. To solve this problem, a firearm such as a handgun or shotgun has a handle or grip for holding or supporting the firearm while pointing the barrel at a target. The grip has at least one groove aligned parallel to the barrel of the firearm for locating or seating a generally cylindrical object such as a flashlight or baton against the grip to allow the firearm and object to be gripped simultaneously while pointing in the same direction.

U.S. Pat. No. 5,353,208 resides in a compact flashlight having an external diameter and length comparable to a typical single AA cell flashlight, but with much higher emitted light intensity. FIG. 10 of the patent shows a simplified longitudinal (side) view showing the manner of attachment of the flashlight to conventional weapon for target illumination. The flashlight is typically held under the barrel of weapon by a clamp which engages the body of flashlight so that light beam is substantially aligned with weapon boresight and bullet trajectory. FIG. 11 of the patent is a simplified, transverse, cross-sectional view through the body of the flashlight when mounted on the weapon, looking toward the muzzle with batteries exposed. The clamp partially encircles the body of the flashlight and is held in place by, for example, screws. FIG. 12 depicts a further embodiment in which a switch is remote from the tail cap, and is desirably mounted on the front face of the weapon grip, e.g., by Velcro or adhesive or a combination thereof, and coupled to flashlight by electrical leads. This arrangement allows the flashlight to be turned on and off while holding the weapon in its firing position.

A mounting apparatus for the quick-detachable securing of a flashlight or a like target illumination device to a firearm is described in U.S. Pat. No. 5,727,346. The mounting device includes a passage for receiving the barrel of the flashlight. The passage is provided with a resilient means to press the flashlight longitudinally along approximately the same axis as the firearm's barrel in opposition to a springably-positioned latch system engaging one end of the flashlight which prevents its dislodgment upon movement of the firearm during handling or discharge, yet enabling relatively quick, one-handed release and replacement of the entire flashlight. The flashlight is prevented from rotating in the passage by a groove in the interior of the passage that engages part of the flashlight body thereby indexing it so that the flashlight's controls are always in the same position and accessible to the user.

Despite these approaches, the need still remains for apparatus and methods for mounting illumination devices with respect to firearms such as rifles, preferably without modification to the gun, thereby allowing the illumination device to be installed and removed in a straightforward manner without modification to the gun.

SUMMARY OF THE INVENTION

This invention provides a tactical and/or home defensive lighting capability to weaponry. A standard magazine endcap is unscrewed and replaced with the light-mounting adapter by screwing it onto the end of the magazine tube. A flashlight is mounted inside the mounting adapter facing forward, so that some portion of the flashlight's battery compartment may extend into the magazine tube. When mounted, the flashlight may be largely internal to the firearm. The exact depth that the flashlight may extend into the magazine tube can vary. A spring guide may be placed on the inside end of the flashlight in order to center the spring in the magazine tube. After installation, the magazine capacity may be slightly lowered.

DETAILED DESCRIPTION OF THE INVENTION

Use of this invention enables a commercially available flashlight to be mounted on or in the forward end of a firearm's magazine, thereby configuring a source of illumination in precise alignment with the bore of the gun. In contrast to prior-art devices, the inventive approach requires no modification to the gun in general or magazine in particular, and may consume the space taken by a single shell, allowing the remainder of the magazine to hold shells, as is typical.

Figure 1:
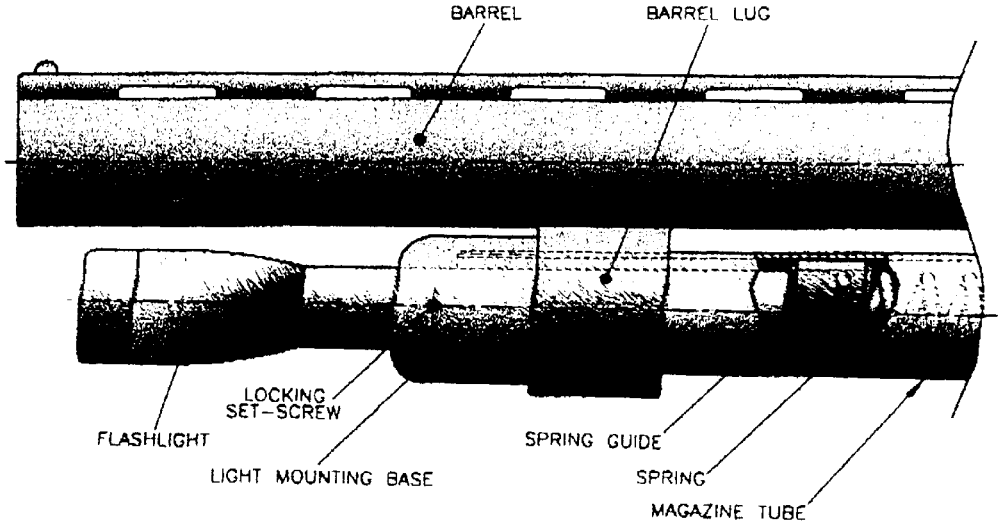
FIG. 1 is a drawing which shows the preferred embodiment of the invention.
Figure 2:
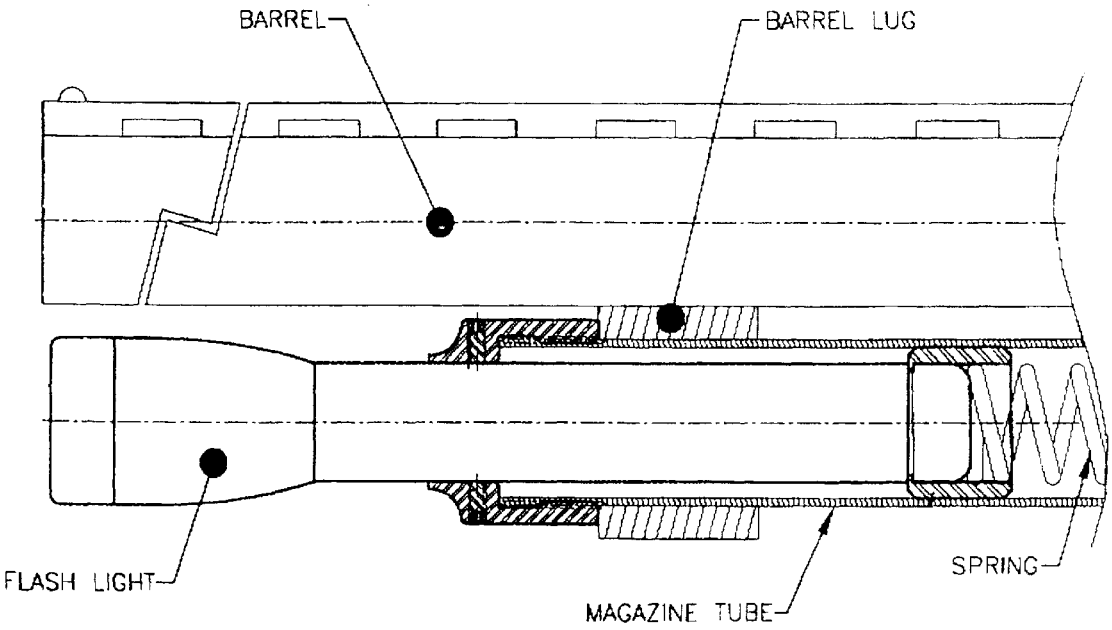
FIG. 2 is a drawing which shows the preferred embodiment in partial cross-section affording additional details.
Figure 3:
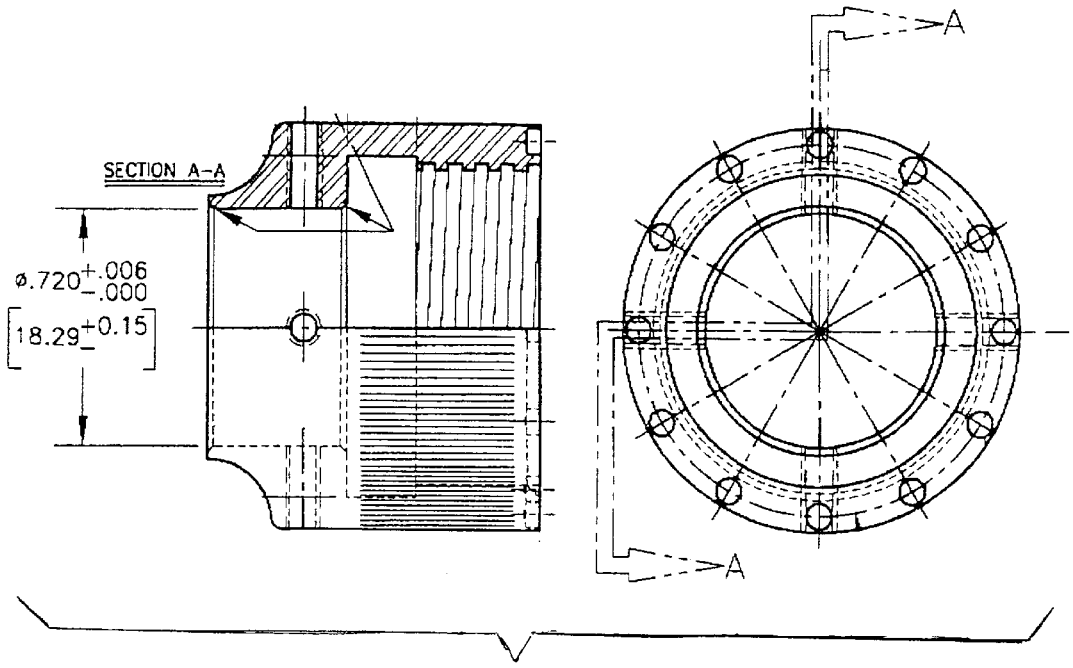
FIG. 3 is a detailed drawing of the preferred mounting base.

The preferred embodiment permits certain types of barreled flashlights, such as the Maglight®, Smith & Wesson®, or Dorcy® having a diameter on the order of 7/10 in., to be mounted on or into the forward end of the magazine through the use of an adapter base module depicted in FIGS. 1, 2 and 3. To position the non-illuminating end of the flashlight in alignment relative to the spring present in the magazine, an optional spring guide in FIGS. 2 and 4 is preferably utilized.

Specific reference will now to be made to the drawings, wherein like numerals refer to the same components throughout. FIG. 1 is a drawing which shows a flashlight mounted within the forward end of a firearm's magazine according to the invention. In the preferred embodiment, the magazine includes a forward end cap which is unscrewed, leaving threads which receive a mounting base best understood with reference to FIGS. 2 and 3. With the mounting base in place, the flashlight may be held in position forward or at different depths into the bore of the magazine, though a position wherein the base of the flashlight consumes approximately that volume otherwise consumed by a standard shell is preferred.

FIG. 2 is a drawing of the preferred embodiment of FIG. 1, in partial cross-section to show the way in which the flashlight is maintained in position. To assist in keeping the non-illuminating end of the flashlight in alignment with the spring internal to the magazine, a spring guide is preferably, though optionally used. A detailed drawing of the spring guide is presented in FIG. 4. FIG. 3 is a detailed drawing of the mounting base. For use with most magazine configurations and a commercially available Maglight® or equivalent, the mounting base is threaded to 12/in. to cooperate with the threads of the forward end of the magazine with the cap removed. The internal bore of the mounting base measures approximately 0.720inches, to receive the flashlight in sliding fashion with at least one set screw preferably being used to lock the flashlight into position. It will be appreciated that although the invention is being described with reference to a particular set of threads and flashlight O.D., alternative dimensions may be used for different styles of magazines and/or flashlights through appropriate modification well within the level of skill of one in the art.

Figure 4:
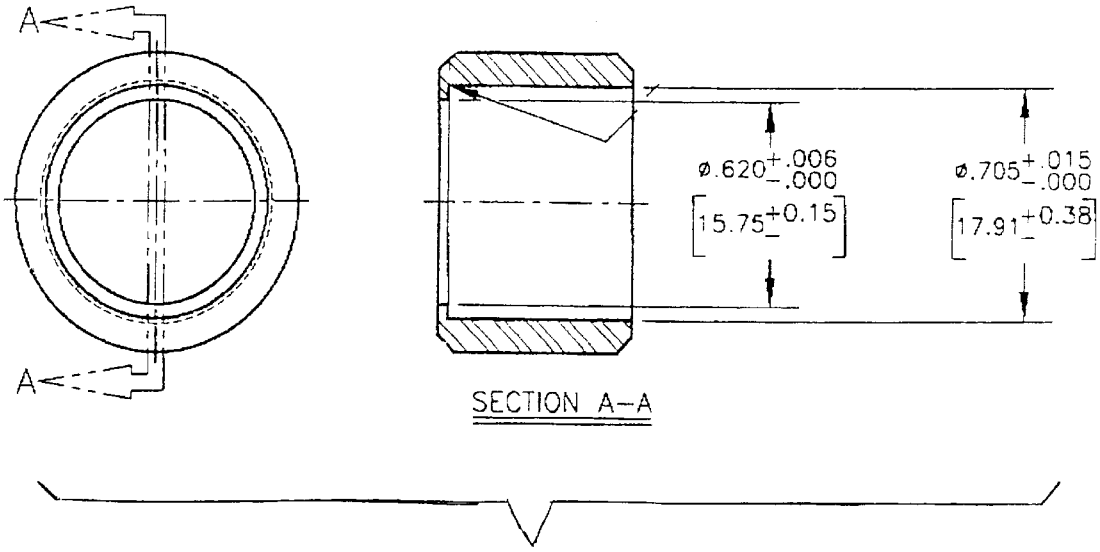
FIG. 4 is a detailed drawing of a spring guide according to the invention.

FIG. 4 is a drawing which shows a preferred spring guide according to the invention. Overall, the guide preferably includes a forward cavity adapted to frictionally engage with the non-illuminating end of the flashlight, and a rearward depression into which the spring may be positioned. Again, however, with different styles or diameters of flashlights and/or springs, the spring guide may be modified as appropriate to accommodate alternative arrangements. Note that, with the flashlight being coupled only to the mounting base, and with the spring guide being frictionally engaged with the base of the flashlight, the flashlight and mounting base may be unscrewed from the magazine, and replaced with the cap with ease, with the mounting base and spring guide remaining attached to the flashlight for future use.

In terms of materials, the mounting base is preferably machined from black Delrin, whereas the spring guide is preferably of a polymeric such as polyethylene, though both parts may be made from plastic or metal, as a matter of engineering, cost or other factors. Although the set screw is of the type wherein a tool is used for tightening/loosening, alternative fasteners may also be used, including those without requiring a tool, such as a thumb screw.

I claim:

1. Apparatus enabling a flashlight having an outer diameter to be mounted into a firearm's magazine having a threaded end cap, the apparatus comprising:

a mounting base having a set of threads which mate with the threads of the magazine with the cap removed;

a bore through the mounting base enabling the flashlight to be slidingly received therein; and a fastener extending through the mounting base enabling the flashlight to be locked into a desired position.

2. The apparatus of claim 1, wherein the threads of the mounting base are 12 per inch.

3. The apparatus of claim 1, wherein the bore through the mounting base is approximately 7/10 inches in diameter.

4. The apparatus of claim 1, further including a spring guide having a forward cavity to frictionally engage with the base of the flashlight; and a rearward depression to receive the end of the spring disposed within the magazine.

* * * * *